US009638132B2

(12) United States Patent
Kobayashi et al.

(10) Patent No.: US 9,638,132 B2
(45) Date of Patent: May 2, 2017

(54) INTERNAL COMBUSTION ENGINE

(71) Applicants: Shinichi Kobayashi, Okazaki (JP); Takahiro Harada, Chiryu (JP)

(72) Inventors: Shinichi Kobayashi, Okazaki (JP); Takahiro Harada, Chiryu (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 105 days.

(21) Appl. No.: 14/423,166

(22) PCT Filed: Aug. 28, 2013

(86) PCT No.: PCT/IB2013/001852
§ 371 (c)(1),
(2) Date: Feb. 23, 2015

(87) PCT Pub. No.: WO2014/033528
PCT Pub. Date: Mar. 6, 2014

(65) Prior Publication Data

US 2015/0252749 A1 Sep. 10, 2015

(30) Foreign Application Priority Data

Aug. 28, 2012 (JP) ..... 2012-187347

(51) Int. Cl.
*F02F 1/36* (2006.01)
*F01M 11/02* (2006.01)

(52) U.S. Cl.
CPC ..... *F02F 1/36* (2013.01); *F01M 11/02* (2013.01); *F01M 2011/023* (2013.01)

(58) Field of Classification Search
CPC ..... F01M 11/02; F01M 11/0004; F01M 2011/007; F01M 2013/0433; F01M 2011/0033; F01M 9/06
(Continued)

(56) References Cited

U.S. PATENT DOCUMENTS 6,820,585 B2 * 11/2004 Maeda ..... F01M 11/02 123/196 R
7,171,937 B2 * 2/2007 Hada ..... F01M 11/0004 123/195 C
(Continued)

FOREIGN PATENT DOCUMENTS

CN 1192158 C 3/2005
EP 1 314 878 A2 5/2003
(Continued)

*Primary Examiner* — Long T Tran
(74) *Attorney, Agent, or Firm* — Oliff PLC

(57) ABSTRACT

In an internal combustion engine, a first oil chamber includes a curved surface portion provided on the upstream side in an oil flow direction and an inclined surface portion provided on the downstream side. The engine is so constructed that oil drops from upper oil passages onto the curved surface portion on the upstream side of the first oil chamber and the inclined surface portion on the downstream side. The curved surface portion on the upstream side has a curved shape which is convex downward, and the inclined surface portion on the downstream side has a slope shape which is inclined downward with respect to the horizontal direction. The curved shape of the curved surface portion on the upstream side is connected to the inclined surface portion before a tangent line of the curved surface portion turns to the horizontal direction.

8 Claims, 7 Drawing Sheets

(58) Field of Classification Search
USPC ..... 123/193.5, 193.2, 196 R, 196 M
See application file for complete search history.

(56) References Cited

U.S. PATENT DOCUMENTS

| | | | | |
|---|---|---|---|---|
| 7,225,786 | B2 * | 6/2007 | Kim | B22C 9/103 123/195 R |
| 8,066,100 | B2 * | 11/2011 | Mori | F01M 11/0004 123/195 C |
| 8,297,407 | B2 * | 10/2012 | Mori | F01M 11/0004 123/195 C |
| 2003/0015164 | A1 * | 1/2003 | Cho | F01M 11/0004 123/195 H |
| 2005/0279314 | A1 * | 12/2005 | Hada | F01M 11/0004 123/192.1 |
| 2009/0277416 | A1 * | 11/2009 | Saito | F01M 11/0004 123/196 AB |
| 2010/0192887 | A1 * | 8/2010 | Iwata | F01L 1/022 123/90.17 |
| 2011/0283968 | A1 * | 11/2011 | Anderson | F01M 1/08 123/196 R |

FOREIGN PATENT DOCUMENTS

| | | | |
|---|---|---|---|
| JP | 2001-207816 | A | 8/2001 |
| JP | 2010-223204 | A | 10/2010 |
| JP | 2011-080420 | A | 4/2011 |
| JP | 2013-104299 | A | 5/2013 |
| JP | 2013-238148 | A | 11/2013 |

* cited by examiner

INTERNAL COMBUSTION ENGINE

BACKGROUND OF THE INVENTION

1. Field of the Invention

The present invention relates to an internal combustion engine, more particularly to an internal combustion engine including a cylinder block containing an oil return space in which a plurality of oil return passages provided in a cylinder head and for returning oil to an oil pan join together in a cylinder head.

2. Description of Related Art

There has been known an internal combustion engine including a cylinder block containing an oil return space in which a plurality of oil return passages provided in a cylinder head join together (see Japanese Patent Application Publication No. 2001-207816 (JP 2001-207816 A), for example)

The internal combustion engine disclosed in the aforementioned JP2001-207816 includes a cylinder block, a cylinder head arranged on the top of the cylinder block, and an oil pan arranged on the bottom of the cylinder block. The cylinder block includes four cylinder bores. A water jacket is provided on the outer periphery of the four cylinder bores so that it surrounds the four cylinder bores. Five oil return passages are provided outside the water jacket such that they are spaced at a predetermined distance. These oil return passages are formed so that they extend along an axial direction of the cylinder bores.

Of five oil return passages, the oil return passage disposed at the most distal end of the cylinder block is connected to a bypass groove in which oil flows in the column direction of the cylinder bores. Oil dropping from the cylinder head drops to the bypass groove and the oil return passage in the cylinder block.

To achieve an increased output of the internal combustion engine, the oil cooling performance has to be improved in accordance with the increase of the output. Furthermore, to improve the cooling performance, it is necessary to secure a sufficient oil flow rate in the oil return space to accelerate heat exchange between the oil and the water jacket in the cylinder block.

However, as regards the internal combustion engine disclosed in the above JP2001-207816, securing of the oil flow rate in the oil return passage (oil return space) of the cylinder block has not been mentioned or suggested. Therefore, it is considered that the internal combustion engine of JP2001-207816 can not achieve sufficiently accelerating of heat exchange between oil and the water jacket. Thus, there is a possibility that no sufficient cooling performance can be secured. Particularly, in case where multiple flows of oil dropping from the cylinder head join together in the oil return passage (oil return space) of the cylinder block, the oil flow rate sometimes may be reduced at a junction.

SUMMARY OF THE INVENTION

An object of the present invention is to provide an internal combustion engine which prevents oil flow rate from being reduced at a junction of the oil flows in an oil return space.

The internal combustion engine according to an aspect of the present invention includes: a cylinder head in which a plurality of oil return passages are provided along the column direction of a plurality of cylinder bores; and a cylinder block which is arranged below the cylinder head, and which has (i) oil return space being in communication with the oil return passages in the cylinder head, and (ii) an oil discharge passage extending in the axial direction of the cylinder bore, and being in communication with oil return space so as to discharge oil in the oil return space to an oil pan. The oil return space includes a first inclined portion provided on the upstream side in the oil flow direction and a second inclined portion provided on the downstream side, so that, in the oil return space, oil from the oil return passage is dropped to the first inclined portion on the upstream side and the second inclined portion on the downstream side. Furthermore, in the internal combustion engine, the first inclined portion on the upstream side has a curved shape which is convex downward and the second inclined portion on the downstream side has a slope shape which is inclined downward with respect to a horizontal direction. The curved shape of the first inclined portion on the upstream side is connected to the second inclined portion on the downstream side before, a tangent line of the first inclined portion turns to the horizontal direction.

In the internal combustion engine according to the aforementioned aspect, by forming the first inclined portion into the curved shape which is convex downward on the upstream side of the oil return space, oil is allowed to drop so that the flow rate of oil is effectively increased compared to a case where the first inclined portion is formed into a flat shape, and therefore, potential energy can be used for increasing the flow rate. On the downstream side of the oil return space, if the curved shape of the first inclined portion is extended to the downstream (the oil return space is formed only with a curved shape), the inclination of the downstream side portion becomes mild, thereby leading to reduction of the oil flow rate. Thus, by inclining the downstream side portion to a direction of returning oil to the oil pan (inclining downward with respect to the horizontal direction), oil can be introduced to the oil pan while reduction of the flow rate is suppressed. Additionally, because oil flowing along the curved surface of the first inclined portion has a high flow rate so that oil is discharged to the oil pan quickly without being deposited in the oil return space. Accordingly, even if oil further drops from the cylinder head onto the downstream side portion of the oil return space, the oil dropped onto the downstream side portion follows the oil flow from the upstream side, thereby securing a sufficient oil flow rate. The inclined shape of the second inclined portion prevents oil flowing from the upstream side from joining with oil just dropped on the downstream side portion from a lateral direction, thereby discharging oil quickly without reducing the flow rate. If the oil flow rate in the oil return space is low, oil layer deposited on a boundary wall surface of the oil return space on the water jacket is generated, thereby causing a disadvantage that heat exchange between oil and the water jacket is not accelerated. To the contrary, if the oil flow rate in the oil return space is high, oil on the boundary wall surface of the oil return space on the water jacket flows, quickly. Consequently, compared to a case where the flow rate of oil is low, the layer of oil deposited on the boundary wall surface of the oil return space on the water jacket is thinned, thereby accelerating the heat exchange between oil and the water jacket. That is, according to the aspect of the present invention, because the sufficient oil flow rate in the oil return space is secured with the above-described structure, the heat exchange between oil and the water jacket of the cylinder block can be accelerated. In the meantime, the flow rate of oil in the oil return space is desired to be equal to or higher than such a flow rate which allows the layer of deposited oil to be thinned.

In the internal combustion engine according to an aspect of the present invention, a plurality of the oil return passages may be arranged above the first inclined portion of the oil return space on the upstream side so that oil drops from the plural portions. With this structure, oil drops from the plural portions onto an area having a largely inclined curved surface of the first inclined portion from the plural portions, thereby securing a more sufficient flow rate.

In the internal combustion engine according to an aspect of the present invention, the inclination angle of the tangent line of the first inclined portion at a connecting portion between the first inclined portion and the second inclined portion in the oil return space may be substantially equal to the inclination angle of the second inclined portion. With this structure, compared to a case where the inclination angle of the second inclined portion in the oil return space is near the horizontal direction, the flow rate of oil dropped to the first inclined portion can effectively be kept at a sufficient level on the inclined surface portion.

In the internal combustion engine according to an aspect of the present invention, the oil return space in the cylinder block may be formed in a flat shape extending along a water jacket in the cylinder block. Furthermore, the first inclined portion and the second inclined portion of the oil return space may be formed so as to extend from the wall surface of the oil return space toward the oil discharge passage along the flat shape of the oil return space. With this structure, oil dropped to the first inclined portion and the second inclined portion can be introduced easily to the oil discharge passage along the flat shape of the oil return space.

In the internal combustion engine according to an aspect of the present invention, the first inclined portion of the oil return space may be of a curved shape based on cycloid curve. With this structure, a time taken for oil on the first inclined portion to flow from a starting point to an end point in the gravity field becomes the shortest (the highest flow rate is attained), thereby preventing the oil flow rate from being reduced at the junction in the oil return space.

In the internal combustion engine of the above-described aspect of the present invention, the reduction of the flow rate of oil at the oil junction in the oil return space can be prevented.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
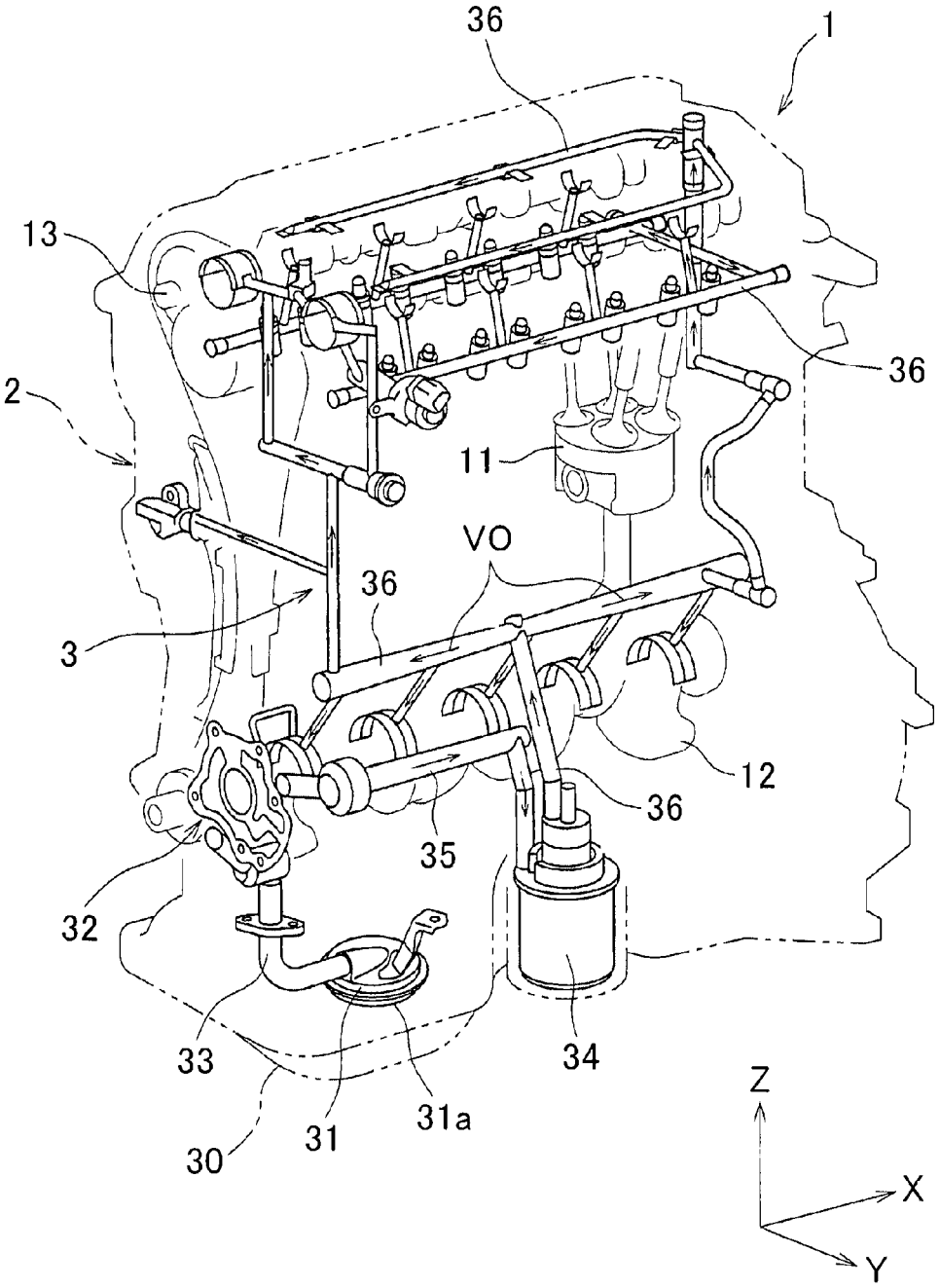
FIG. 1 is a structural view showing an example of an oil circulation system of an engine according to an embodiment of the present invention.

Hereinafter, embodiments of an internal combustion engine according to the present invention will be described with reference to the accompanying drawings.

—Oil Circulation System—

An embodiment of the present invention will be described with reference to FIGS. 1 to 7. First, the oil circulation system in an in-line four-cylinder engine according to the embodiment of the present invention will be described with reference to FIG. 1. An engine 1 includes an engine block 2 containing a variety of lubricated mechanisms (mechanism in which oil is circulated) such as a piston 11, a crank shaft 12, a cam shaft 13, and a lubricating system 3 for circulating oil which lubricates the various lubricated mechanisms in the engine 1. It should be noted that the engine 1 is an example of the "internal combustion engine" of the present invention.

Figure 2:
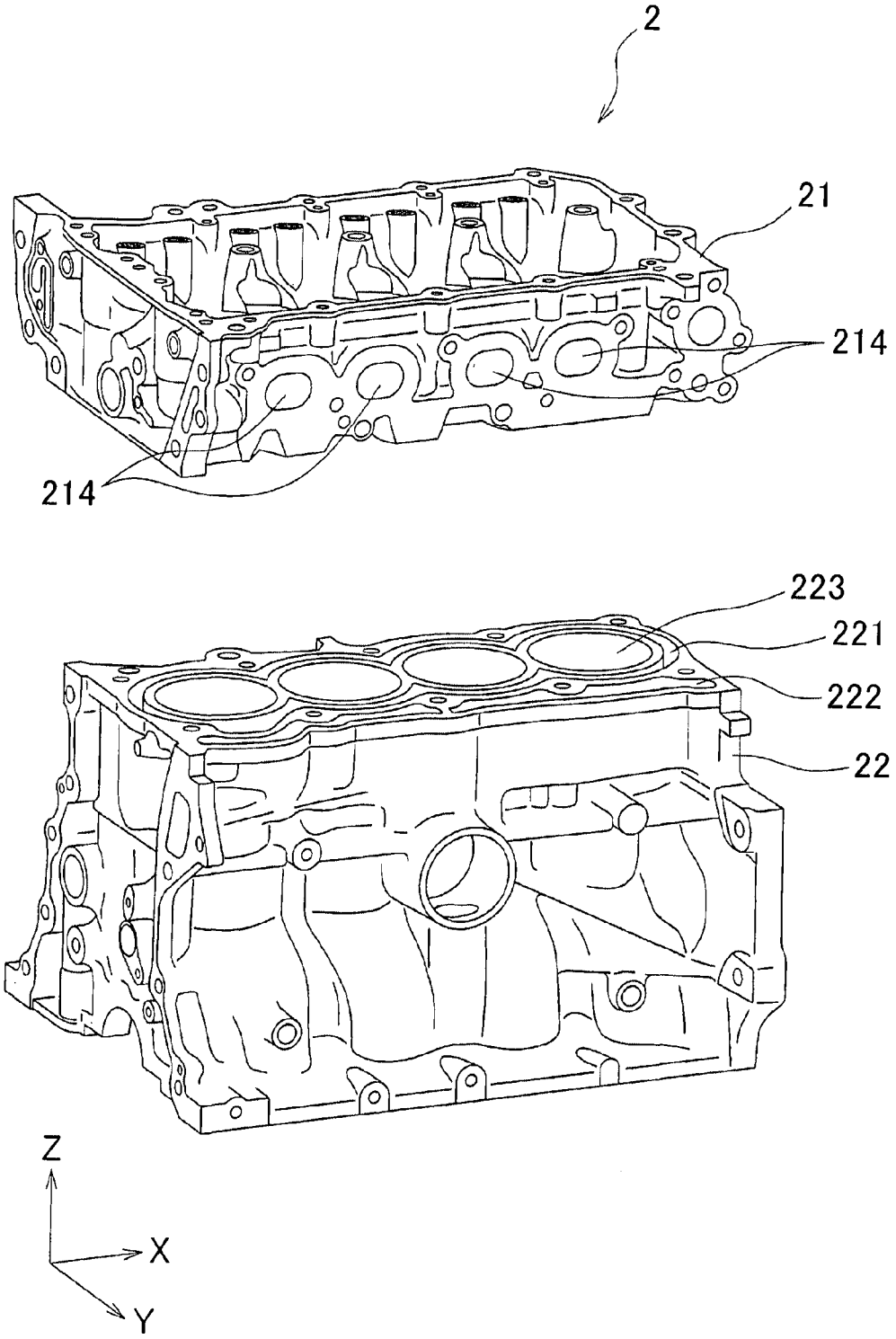
FIG. 2 is a perspective view showing an example of an engine block according to the present embodiment.

As show in FIG. 2, the engine block 2 includes a cylinder head 21 and a cylinder block 22. As shown in FIG. 1, a variety of lubricated members (object members to be lubricated with oil) such as a piston 11, a crank shaft 12, and a cam shaft 13 are arranged in the cylinder head 21 and the cylinder block 22. An oil pan 30 stores oil to be supplied to the lubricated members is arranged on the bottom portion of the engine block 2.

The lubricating system 3 is constructed as follows, so as to be able to supply oil stored inside the oil pan 30 to the above-mentioned variety of the lubricated members.

An oil strainer 31 is arranged inside the oil pan 30. The oil strainer 31 removes foreign matters and the like in oil, and has a suction port 31*a* for sucking oil stored in the oil pan 30. The oil strainer 31 is connected to an oil pump 32 provided in the engine block 2 via a strainer passage 33.

The oil pump 32 sucks oil stored in the oil pan 30 and supplies lubricated members with the oil as lubricant via an oil filter 34 and is constructed of, for example, a rotary pump. A rotor of the oil pump 32 is engaged with the crank shaft 12 so that it is rotated with a rotation of the crank shaft 12. Furthermore, the oil pump 32 is connected to an oil intake of the oil filter 34 provided outside the engine block 2 via an oil transport pipe 35. An oil outlet of the oil filter 34 is connected to an oil supply pipe 36 provided as an oil passage directed to the aforementioned various lubricated members.

When an operation of the engine 1 is started, the oil pump 32 is driven with a rotation of the crank shaft 12. As indicated with arrows VO in FIG. 1, the oil pump 32 sucks oil stored in the oil pan 30 through the suction port 31*a* of the oil strainer 31 and supplies the sucked oil to the members to be lubricated within the engine block 2 via the oil transfer pipe 35, the oil filter 34, and the oil supply pipe 36. The oil supplied to the lubricated members functions as lubricant for the lubricated members and after absorbing heat such as frictional heat generated during an operation of each lubricated member, drops due to the gravity so that it is collected in the oil pan 30.

—Cylinder Head—

Figure 3:
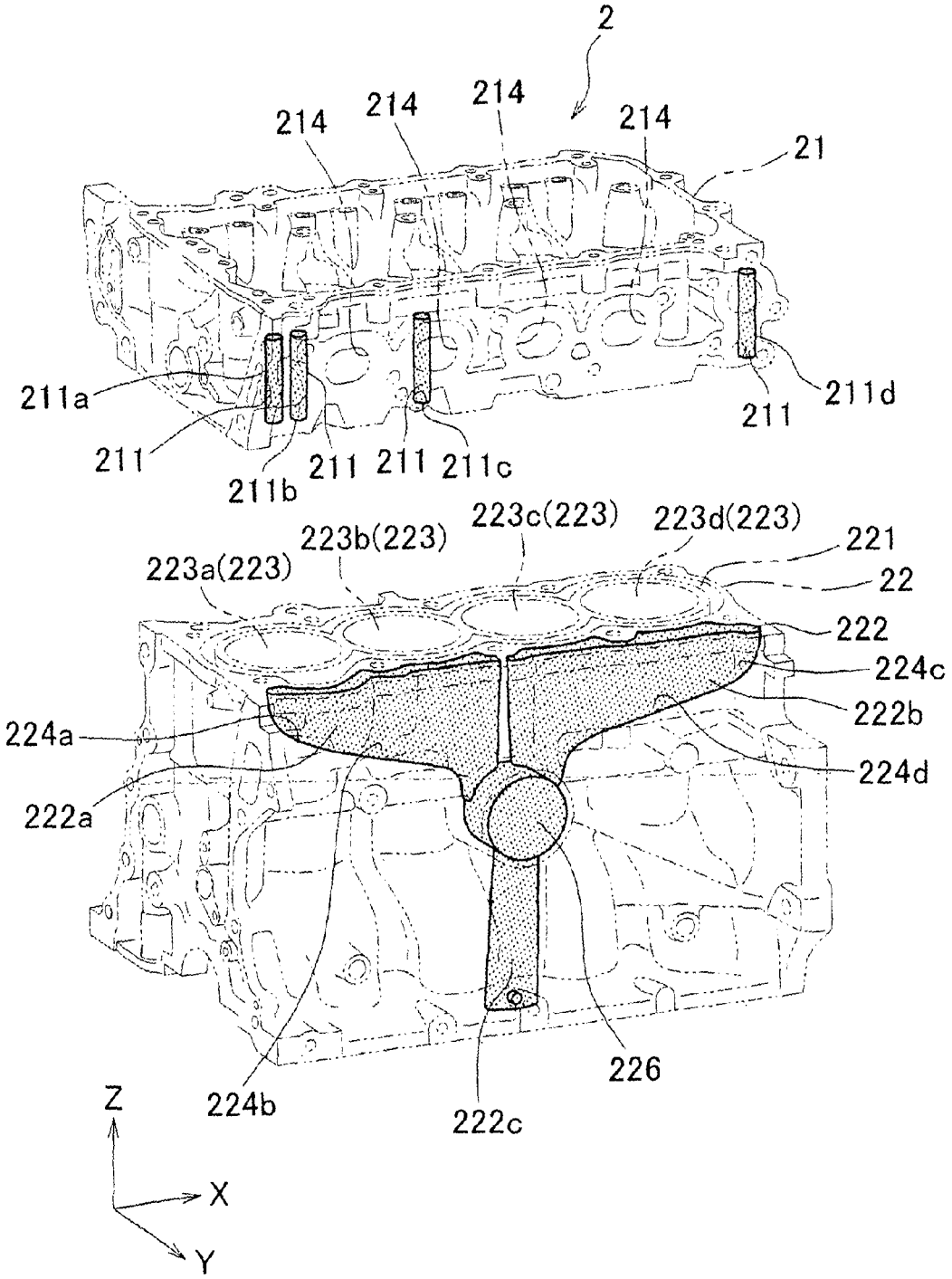
FIG. 3 is a perspective view showing an example of an oil passage formed in the engine block according to the present embodiment.

Next, the structure of the cylinder head 21 will be described. As shown in FIG. 1, a variety of the lubricated members such as the cam shaft 13 are arranged in an upper portion of the cylinder head 21, and as shown in FIGS. 2 and 3, four exhaust ports 214 are arranged on a side surface of the cylinder head 21.

Each of the exhaust ports 214 is connected to each cylinder bore 223 to discharge exhaust gas to an exhaust manifold (not shown). A cylinder gasket (not shown) for preventing a leakage of combustion gas, cooling water, and oil is located in between the cylinder head 21 and the cylinder block 22. As shown in FIG. 3, the cylinder head 21 contains four upper oil passages 211 (211*a*, 211*b*, 211*c*, 211*d*) which are spaced at an appropriate interval. In the meantime, the upper oil passages 211 (211*a*, 211*b*, 211*c*, 211*d*) are an example of the "oil return passage" according to the present invention.

—Cylinder Block—

Next, a structure of the cylinder block 22 will be described. As shown in FIG. 2, the cylinder block 22 includes a water jacket 221, an intermediate oil passage 222, and the cylinder bores 223. In the meantime, the intermediate oil passage 222 is an example of the "oil return space" of the present invention.

The cylinder bore 223 is formed substantially in a cylindrical shape such that a piston 11 (see FIG. 1) is accommodated slidably and a combustion chamber (not shown) is formed at a top end portion of the cylinder bore 223. It should be noted that the combustion chamber is constructed of a top surface of the piston 11, an internal circumferential face of the cylinder bore 223, and a part of the bottom surface of the cylinder head 21.

The water jacket 221 is used to cool the wall surface of the cylinder bores 223 with cooling water and is formed along the outer circumference of the cylinder bores 223 (cylinder bores 223*a*, 223*b*, 223*c*, and 223*d*). The water jacket 221 has a flow intake (not shown) and a flow outlet (not shown).

Figure 4:
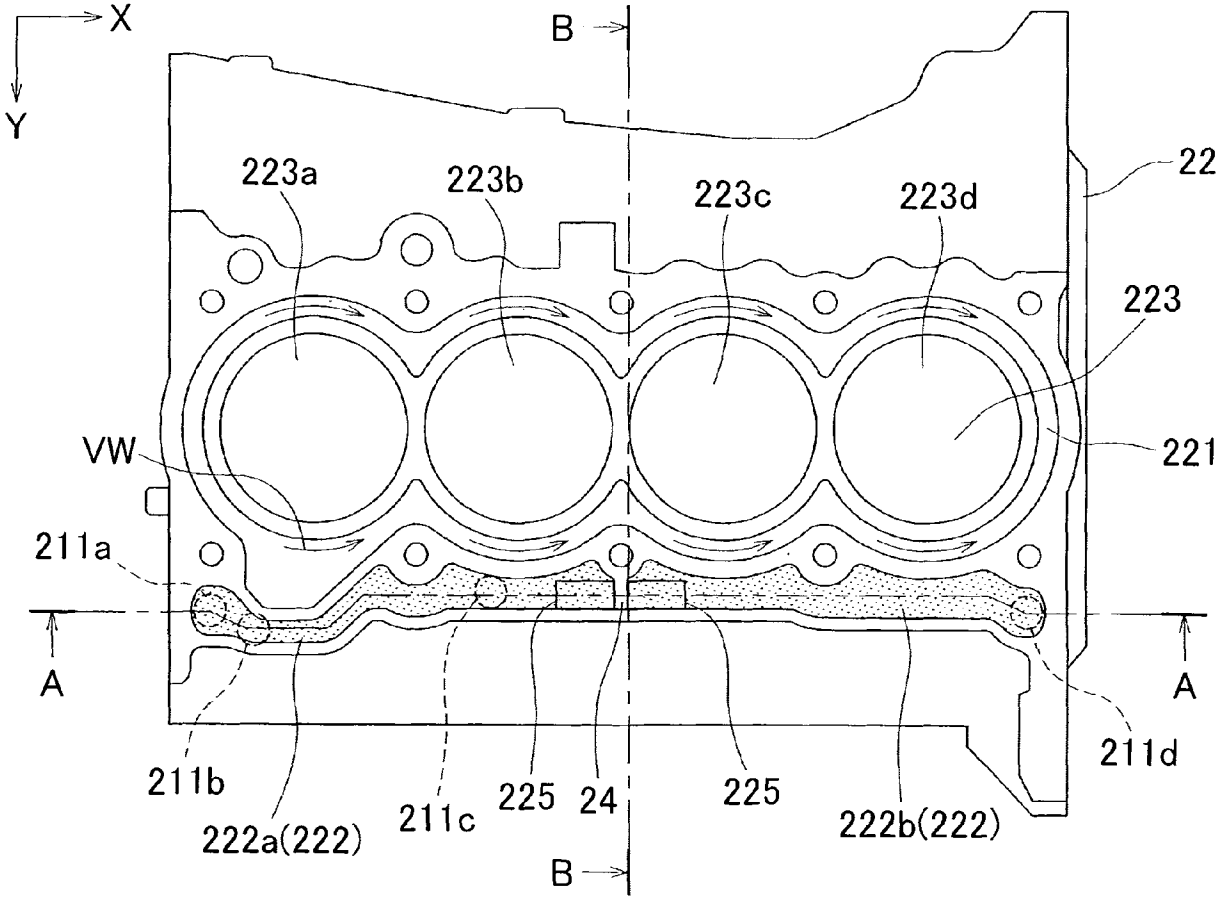
FIG. 4 is a plan view of a cylinder block according to the present embodiment.

The flow intake of the water jacket 221 is so constructed to be supplied with cooling water from a water pump (not shown). As shown in FIG. 4, cooling water charged from the flow intake flows along the outer circumferences of each of the cylinder bores 223*a*, 223*b*, 223*c* and 223*d* sequentially in the direction of arrows VW, and is discharged from the flow outlet formed on the outer circumference of the cylinder bore 223*d*. The cooling water discharged from the flow outlet is sent to a radiator (not shown), which emits heat collected by the cooling water to the atmosphere.

—Entire Structure of Oil Passage—

First, an entire structure of the oil passage will be described. As shown in FIGS. 1 and 3, the upper oil passages 211 in the cylinder head 21 allow oil dropping from each lubricated member such as the cam shaft 13 arranged in an upper portion of the cylinder head 21 to drop to the vicinity of the top end of the cylinder block 22. The intermediate oil passage 222 is so constructed that oil dropping from the upper oil passages 211*a* to 211*d* in the cylinder head 21 flows therein. The intermediate oil passage 222 is so constructed to allow oil dropping from the upper oil passages 211 to drop up to the oil pan 30.

That is, oil dropping from the lubricated members such as the cam shaft 13 arranged in the upper portion of the cylinder head 21 passes through the upper oil passages 211 formed in the cylinder head 21 and the intermediate oil passage 222 formed in the cylinder block 22 and drops down to the oil pan 30.

—Structure of Upper Oil Passage—

Next, a structure of the upper oil passages 211*a* to 211*d* will be described. As shown in FIG. 3, the four upper oil passages 211*a* to 211*d* in the cylinder head 21 are arranged along the column direction of the cylinder bores 223 (X-axis direction). The upper oil passages 211*a* to 211*d* are substantially-circular cylindrical holes having a substantially circular cross-section extending in the axial direction (Z-axis direction) of the cylinder bore 223.

—Structure of Intermediate Oil Passage—

Next, a structure of the intermediate oil passage 222 will be described. As shown in FIG. 3, the intermediate oil passage 222 allows oil dropping from the upper oil passages 211*a* to 211*d* in the cylinder head 21 to drop down to the oil pan 30 (see FIG. 1) arranged on the bottom of the cylinder block 22. The intermediate oil passage 222 includes two oil chambers, i.e., a first oil chamber 222*a* and a second oil chamber 222*b*. A lower oil passage 222*c* is connected to the first oil chamber 222*a* and the second oil chamber 222*b* via a connecting passage 226 below the first oil chamber 222*a* and the second oil chamber 222*b*. In the meantime, the first oil chamber 222*a* is an example of the "oil return space" of the present invention, and the lower oil passage 222*c* is an example of the "oil discharging passage" of the present invention.

Figure 5:
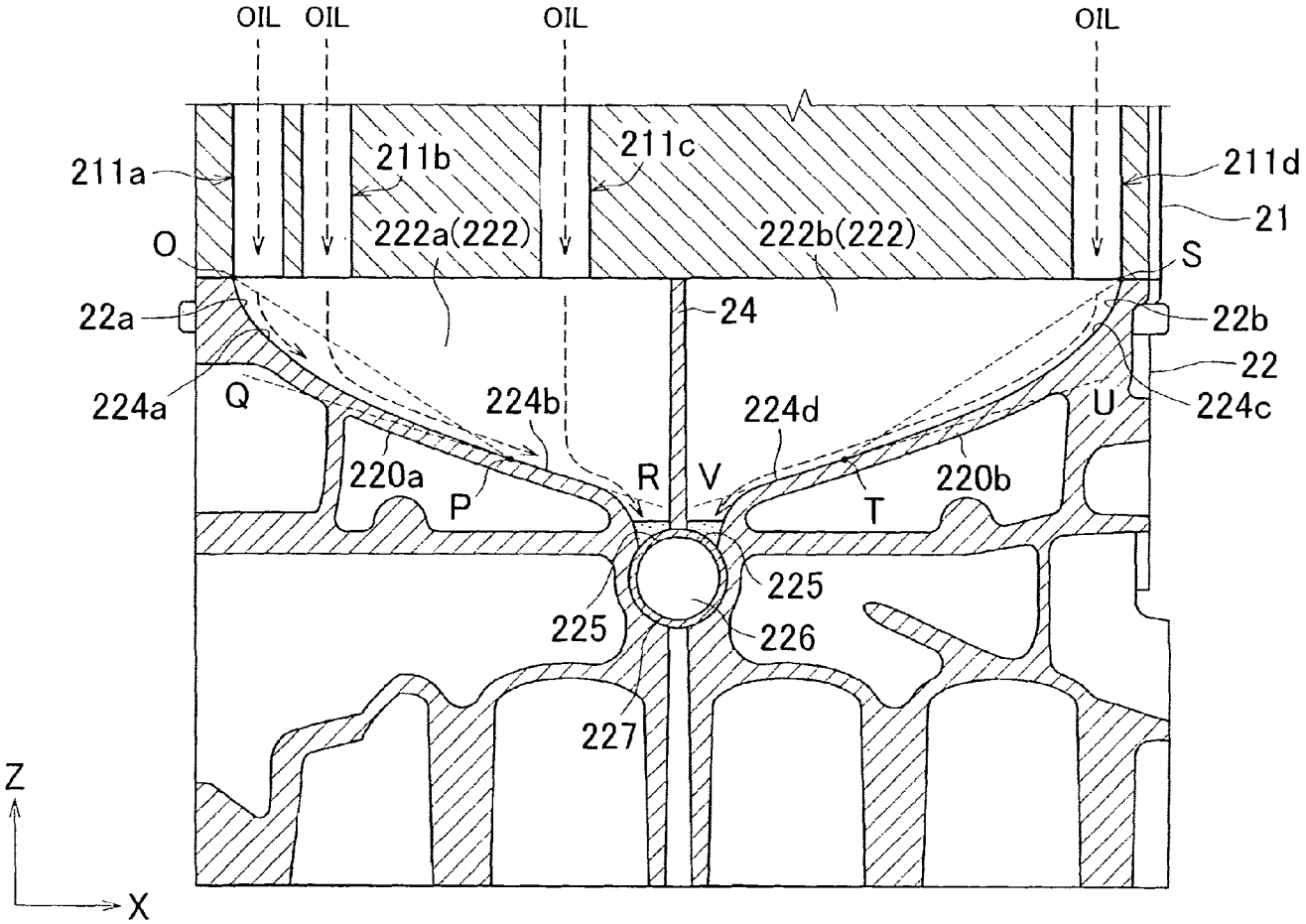
FIG. 5 is a sectional view taken along A-A in the cylinder block shown in FIG. 4.

As shown in FIG. 5, the first oil chamber 222*a* and the second oil chamber 222*b* function as an oil passage which allows oil dropping through the upper oil passages 211*a* to 211*d* to drop down to the vicinity of the bottom position of the water jacket 221 (see FIG. 4). This structure allows oil in the first oil chamber 222*a* and the second oil chamber 222*b* to perform heat exchange with cooling water in the water jacket 221 effectively, so that oil in the first oil chamber 222*a* and the second oil chamber 222*b* can be cooled sufficiently.

As shown in FIG. 4, the first oil chamber 222*a* and the second oil chamber 222*b* are provided such that they extend in the column direction (X-axis direction or right-left direction in FIG. 4) of the four cylinder bores 223 (223*a* to 223*d*) along the water jacket 221. Further, the first oil chamber 222*a* and the second oil chamber 222*b* are formed in a flat shape which is longer in the vertical direction (Z-axis direction in FIG. 3) than the width direction (Y-axis direction).

A partition wall portion 24 which separates the first oil chamber 222*a* from the second oil chamber 222*b* is formed in the vicinity of the center in the column direction (X-axis direction) of the cylinder bores 223 of the intermediate oil passage 222. The first oil chamber 222*a* and the second oil chamber 222*b* are formed substantially symmetrically with respect to the partition wall portion 24.

The first oil chamber 222*a* and the second oil chamber 222*b* are formed substantially horizontally (along the X-axis direction). That is, the first oil chamber 222*a* and the second oil chamber 222*b* are formed substantially in parallel to the X-axis.

The first oil chamber 222*a* and the second oil chamber 222*b* are so constructed that the width thereof narrows gradually along the direction of oil flow (downward). That is, the first oil chamber 222*a* and the second oil chamber 222*b* are tapered in a direction in which oil drops (downward).

According to the present embodiment, as shown in FIG. 5, the three upper oil passages 211*a* to 211*c* are arranged at intervals above the first oil chamber 222*a*. The upper oil passage 211*d* is arranged above the second oil chamber 222*b*. A bottom face 220*a* of the first oil chamber 222*a* extends toward the lower oil passage 222*c* to guide oil dropping from the upper oil passages 211*a* to 211*c* downward (in the direction of the lower oil passage 222*c*). A bottom face 220*b* of the second oil chamber 222*b* extends toward the lower oil passage 222*c* to guide oil dropping from the upper oil passage 211*d* downward (in the direction of the lower oil passage 222*c*).

A curved surface portion 224*a* which is convex in a downward direction (in a direction to the oil pan 30) is formed in a wall surface 22*a* (negative direction side of the X-axis) of the first oil chamber 222*a*. An inclined surface portion 224*b* connected to the curved surface portion 224*a* is formed on the connecting passage 226 side of the curved surface portion 224*a*. In the meantime, the curved surface portion 224*a* is an example of the "first inclined portion" of the present invention, and the inclined surface portion 224*b* is an example of the "second inclined portion" of the present invention. The curved surface portion 224*a* and the inclined surface portion 224*b* are formed such that they extend in the direction (X-axis direction) along the flat shape of the first oil chamber 222*a* (intermediate oil passage 222).

The upper oil passages 211*a*, 211*b* are arranged above the curved surface portion 224*a* of the first oil chamber 222*a*. The upper oil passage 211*c* is arranged above the inclined surface portion 224*b*. The curved surface portion 224*a* extends up to an area (point P) in the vicinity of just below the upper oil passage 211*c* and after that, turns to the inclined surface portion 224*b*. As a result, even if the multiple upper oil passages join together, a sufficient flow rate can be secured.

The curved surface portion 224*a* has a curved shape based on cycloid curve. The cycloid curved shape is a curved shape that allows a mass point to move between arbitrary two points in the gravity field in a shortest time. In the present embodiment, as shown in FIG. 5, comparing oil flowing on a curve (curved surface portion 224*a*) passing through two points O, P with oil flowing on a straight line (dotted line), the oil flowing on the curve (curved surface portion 224*a*) flows between the two points O, P in a shorter time. It should be noted that the aforementioned curve is called Brachistochrone curve.

The inclined surface portion 224*b* is formed such that it is inclined at a predetermined angle with respect to the direction along a mating face between the cylinder head 21 and the cylinder block 22 (horizontal direction or X-axis direction). The inclination angle of the inclined surface portion 224*b* is substantially equal to an inclination angle of a tangent line Q-R at a point P of the curved surface portion 224*a*. Furthermore, the tangent line Q-R at the point P of the curved surface portion 224*a* is inclined toward the connecting passage 226 side with respect to the horizontal direction (a direction along the mating face between the cylinder head 21 and the cylinder block 22).

As regards a route of oil flowing within the first oil chamber 222*a*, first, oil dropping from the upper oil passage 211*a* flows along the curved shape of the curved surface portion 224*a* to the inclined surface portion 224*b* side in a state in which the highest flow rate is secured (with a high flow rate secured).

Then, oil flowing on the curved surface portion 224*a* joins oil dropping from the upper oil passage 211*b*. Because at this time, oil dropping from the upper oil passage 211*b* drops on the surface of the curved shape of the curved surface portion 224*a*, a sufficient flow rate is secured at a junction where oil dropping from the upper oil passage 211*b* and oil flowing from the curved surface portion 224*a* join together so that the joining oil flows to the inclined surface portion 224*b*.

After that, oil flowing on the inclined surface portion 224*b* joins with oil dropping from the upper oil passage 211*c*. The inclined surface portion 224*b* is formed such that it obliquely intersects with an extension line extending along an axis of the upper oil passage 211*c*. Thus, oil dropping from the upper oil passage 211*c* drops obliquely with respect to the surface of the inclined surface portion 224*b*. This structure rectifies oil flow at the junction where oil dropping from the upper oil passage 211*c* and oil flowing from the curved surface portion 224*a* join together into a single direction (direction to the connecting passage 226) so that the joining oil flows to the lower oil passage 222*c* (see FIG. 3).

Oil which drops from the upper oil passages 211*a* to 211*c* into the first oil chamber 222*a* and flows to the lower oil passage 222*c* flows in a positive direction of the X-axis (rightward in FIG. 5) while being cooled by cooling water flowing within the water jacket 221, and then flows to the lower oil passage 222*c*.

Furthermore, a curved surface portion 224*c* which is convex in a downward direction (in a direction to the oil pan 30) is formed in a wall surface 22*b* (positive direction side of the X-axis) of the upper oil passage 211*d* of the second oil chamber 222*b*. An inclined surface portion 224*d* connected to the curved surface portion 224*c* is formed on a connecting passage 226 side of the curved surface portion 224*c*. The curved surface portion 224*c* and the inclined surface portion 224*d* are formed such that they extend in a direction (X-axis direction) along the flat shape of the second oil chamber 222*b* (intermediate oil passage 222). The upper oil passage 211*d* is arranged above the curved surface portion 224*c* of the second oil chamber 222*b*. The curved surface portion 224*c* extends up to an area (point T) in the vicinity of just below the upper oil passage 211*d* and after that, turns to the inclined surface portion 224*d*.

This curved surface portion 224*c* has a curved shape based on cycloid curve, which means such a curved shape which, like the curved surface portion 224*a* of the first oil chamber 222*a*, allows a mass point to move between arbitrary two points in the gravity field in a shortest time. In the present embodiment, as shown in FIG. 5, comparing oil flowing on a curve (curved surface portion 224*c*) passing through two points S, T with oil flowing on a straight line (dotted line), the oil flowing on the curve (curved surface portion 224*c*) flows between the two points S, T in a shorter time.

The inclined surface portion 224*d* connected to the connecting passage 226 side of the curved surface portion 224*c* is formed such that it is inclined at a predetermined angle with respect to a direction along a mating face between the cylinder head 21 and the cylinder block 22 (horizontal direction or X-axis direction). The inclination angle of the inclined surface portion 224*d* is substantially equal to an inclination angle of a tangent line U-V at a point T of the curved surface portion 224*c*. Furthermore, the tangent line U-V at the point T of the curved surface portion 224*c* is inclined toward the connecting passage 226 side with, respect to the horizontal direction (a direction along the mating face between the cylinder head 21 and the cylinder block 22).

As regards a route of oil flowing in the second oil chamber 222*b*, first, oil dropping from the upper oil passage 211*d* flows along the curved shape of the curved surface portion 224*c* to the inclined surface portion 224*d* side at the highest flow rate (with a high flow rate secured), and after that, it flows to the lower oil passage 222*c*.

Oil which drops from the upper oil passages 211*d* into the second oil chamber 222*b* and flows to the lower oil passage 222*c* flows in a negative direction of the X-axis (leftward in FIG. 5) while being cooled by cooling water flowing within the water jacket 221, and then flows to the lower oil passage 222*c*.

Figure 6:
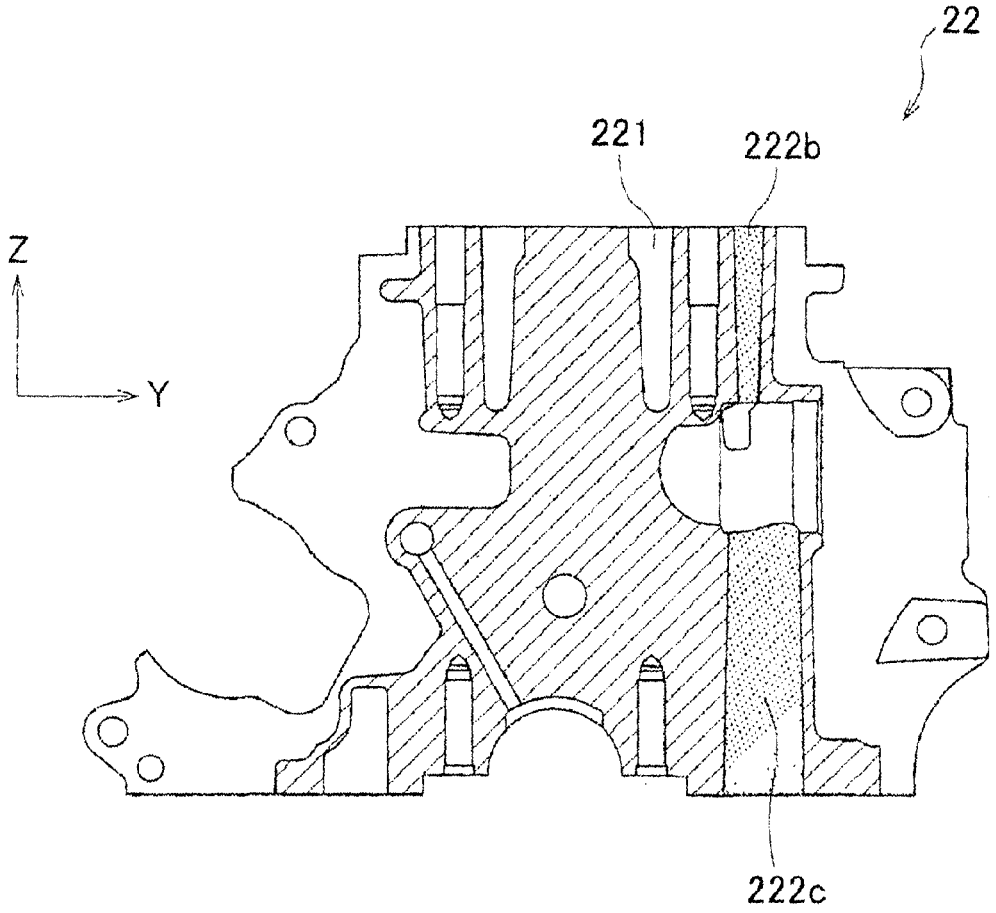
FIG. 6 is a sectional view taken along B-B in the cylinder block shown in FIG. 4.

As shown in FIG. 6, the lower oil passage 222*c* is an passage which allows oil dropping from the first oil chamber 222*a* (second oil chamber 222*b*) to drop to the oil pan 30. The lower oil passage 222*c* joins oil dropping from the first oil chamber 222*a* and oil dropping from the second oil chamber 222*b* together in the vicinity of the bottom end of the water jacket 221 and after that, allows the joined oil to drop substantially vertically to the oil pan 30 (see FIGS. 3, 6).

With the above-described structure, oil passing the bottom end position of the water jacket 221 can drop up to the oil pan 30 quickly, thereby preventing the oil passing through the lower oil passage 222*c* from receiving heat.

—Structure of Connecting Portion of Intermediate Oil Passage and Lower Oil Passage—

Figure 7A:
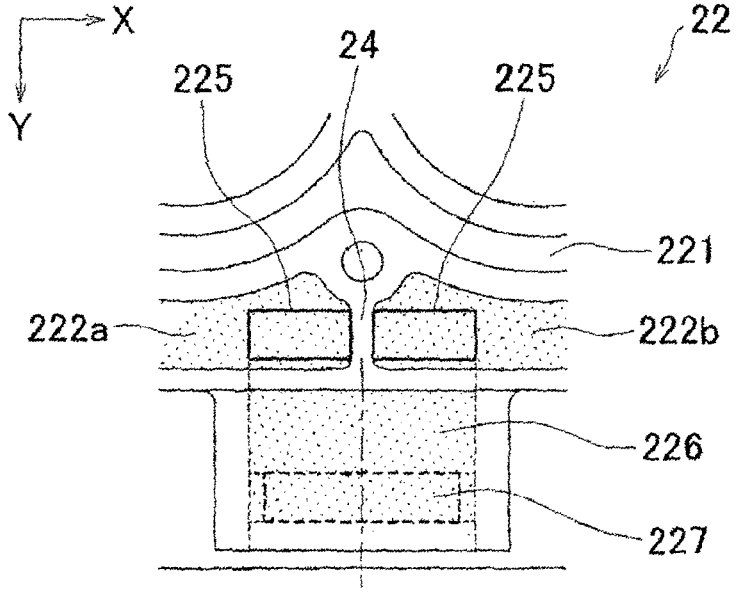
FIGS. 7A and 7B are partially enlarged views respectively showing a connecting portion of oil passages in the cylinder block according to the present embodiment.
Figure 7B:
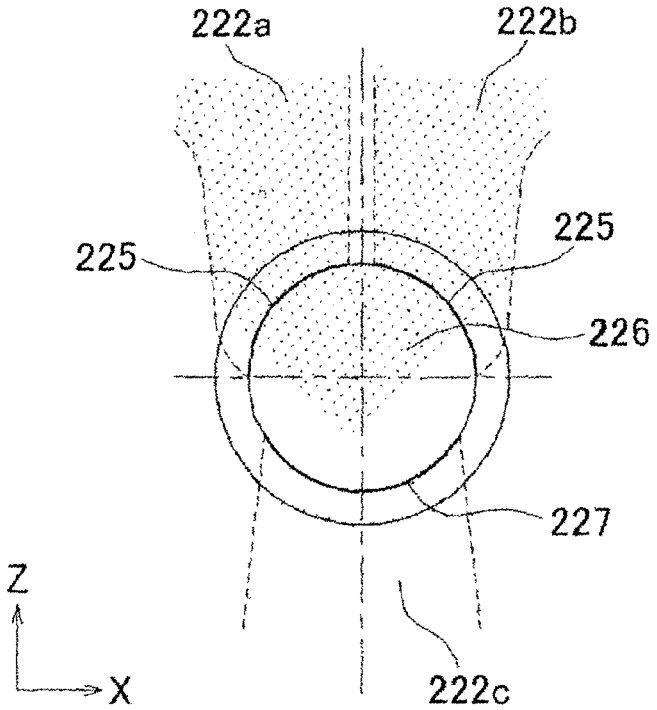

Next, a structure of a connecting portion of the lower oil passage 222*c* with the first oil chamber 222*a* and the second oil chamber 222*b* will be described with reference to FIGS. 7A and 7B. FIG. 7A is a top view of an area in the vicinity of the connecting portion of the lower oil passage 222*c* with, the first oil chamber 222*a* and the second oil chamber 222*b*. FIG. 7B is a side view of an area in the vicinity of the connecting portion of the lower oil passage 222*c* with the first oil chamber 222*a* and the second oil chamber 222*b*.

The connecting passage 226 is formed between the bottom end portions of the first oil chamber 222*a* and the second oil chamber 222*b* and the top end portion of the lower oil passage 222*c*. It should be noted that the connecting passage 226 is described as a part of the lower oil passage 222*c*. The connecting passage 226 is formed in a substantially cylindrical shape in the Y-axis direction (forward and backward with respect to this paper surface).

Two substantially square holes 225 are formed at an end portion in the negative direction of the Y-axis of the top side face of the connecting passage 226. The holes 225 allow oil to drop from the first oil chamber 222*a* and the second oil chamber 222*b* to the connecting passage 226. That is, oil dropping from the first oil chamber 222*a* and the second oil chamber 222*b* passes each of the holes 225 and flows into the connecting passage 226. Then, after passing the holes 225 and flowing into the connecting passage 226, the oil flows in the positive direction of the Y-axis through the connecting passage 226.

Furthermore, a substantially square hole 227 is formed at an end portion in the positive direction of the Y-axis on the bottom side surface of the connecting passage 226. The hole 227 allows oil to drop from the connecting passage 226 to a vertical passage as the lower oil passage 222*c*. That is, after flowing in the positive direction of the Y-axis through the connecting passage 226, the oil flows into the vertical passage as the lower oil passage 222*c*.

As described above, the engine 1 of the present embodiment ensures following advantages.

According to the present embodiment, as described above, the curved surface portion 224*a* on the upstream side is convex downward, and the inclined surface portion 224*b* on the downstream side is inclined downward with respect to the horizontal direction (direction along a mating face between the cylinder head 21 and the cylinder block 22), and the curved shape of the curved surface portion 224*a* on the upstream side is connected to the inclined surface portion 224*b* on the downstream side before the tangent line Q-R of the curved surface portion 224*a* turns to the horizontal direction. By forming the curved surface portion 224*a* in the downwardly convex shape on the upstream side of the first oil chamber 222*a*, for example, the oil can drop effectively at the higher flow rate than a case where the upstream side surface is flat. As a result, the potential energy can be used for improvement of the flow rate. If the curved shape of the curved surface portion 224*a* is extended in the downstream (if the first oil chamber 222*a* is only formed in the curved shape) on the downstream of the first oil chamber 222*a*, for example, the inclination of the downstream side becomes mild, thereby leading to reduction of the oil flow rate. Thus, by inclining the downstream side portion into a direction of returning oil to the oil pan 30 (inclined more downward than horizontally), oil can be introduced to the oil pan 30 while its flow rate is prevented from being reduced. Furthermore, oil flowing along the curve of the curved surface portion 224*a* flows at the high flow rate so that it is discharged quickly into the oil pan 30 without being deposited in the first oil chamber 222*a*. Consequently, even when oil drops further from the cylinder head 21 on the downstream side of the first oil chamber 222*a*, oil dropped on the downstream side follows a flow of oil on the upstream side, thereby securing a constant oil flow rate. In addition, the inclined shape of the inclined surface portion 224*b* prevents oil flowing from the upstream side from joining with oil just dropped on the downstream side portion from a lateral direction, thereby discharging oil quickly without reducing the flow rate. If the oil flow rate in the first oil chamber 222*a* is low, the layer of the oil deposited on a boundary wall surface of the first oil chamber 222*a* on the water jacket 221 is generated, thereby causing a disadvantage that heat exchange between oil and the water jacket 221 is not accelerated. To the contrary, if the oil flow rate in the first oil chamber 222*a* is high, oil on the boundary wall surface of the first oil chamber 222*a* on the water jacket 221 flows quickly. Consequently, comparing with a case where the oil flow rate is low, the layer of oil deposited on the boundary wall surface of the first oil chamber 222*a* on the water jacket 221 is thinned, thereby accelerating the heat exchange between oil and the water jacket 221. That is, according to the present invention of the invention, because the oil flow rate in the first oil chamber 222*a* is secured with the above-described structure, the heat exchange between oil and the water jacket 221 of the cylinder block 22 can be accelerated. It should be noted that the oil flow rate in the first oil chamber 222*a* is desired to be equal to or higher than such a flow rate which allows the layer of the deposited oil to be thinned.

According to the present embodiment, as described above, the two upper oil passages 211*a*, 211*b* are arranged above the curved surface portion 224*a* on the upstream side of the first oil chamber 222*a* so that oil drops from the two positions. As a result, oil drops to an area having a largely inclined curved surface of the curved surface portion 224*a* from the two positions, thereby securing a more sufficient flow rate.

Furthermore, according to the present embodiment, as described above, the inclination angle of the tangent line Q-R of the curved surface portion 224*a* at the connecting point (point P) between the curves surface portion 224*a* and the inclined surface portion 224*b* is set substantially equal to the inclination angle of the inclined surface portion 224*b*. Thus, comparing with a case where the inclination angle of the inclined surface portion 224*b* is near the horizontal direction, the flow rate of oil dropped to the curved surface portion 224*a* can effectively be kept at an appropriate level on the inclined surface portion 224*b*.

According to the present embodiment, as described above, the first curved surface portion 224*a* and the inclined surface portion 224*b* of the first oil chamber 222*a* are formed such that they extend from the wall surface 22*a* of the first oil chamber 222*a* toward the lower oil passage 222*c* along the flat shape of the first oil chamber 222*a*. As a result, oil dropped to the curved surface portion 224*a* and the inclined surface portion 224*b* can be introduced easily to the lower oil passage 222*c* along the flat shape of the first oil chamber 222*a*.

According to the present embodiment, as described above, the curved surface portion 224*a* is formed in a curved shape based on the cycloid curve. As a consequence, a time taken for oil on the curved surface portion to flow from the starting point O to the end point P in the gravity field becomes the shortest (the highest flow rate is attained), thereby preventing the oil, flow rate from being reduced at the junction of the first oil chamber 222*a*.

Other Embodiments

It should be considered that the embodiments disclosed here are just examples of the present invention and do not restrict the present invention. The scope of the present invention is not limited to the above-described description of the embodiments but indicated in the claims of the invention, and includes equivalents of the claims as well as all modifications and changes within the scope of the invention.

For example, although, in the above embodiment, an example that the present invention is applied to the in-line four-cylinder engine has been indicated, the present invention is not restricted to this example. The present invention can be applied to engines other than the in-line four-cylinder engine.

Although in the present embodiment, an example that four upper oil passages are formed in the cylinder head has been indicated, the present invention is not restricted to this example. For example, it is permissible to form more than four upper oil passages in the cylinder head.

Although in the above-described embodiments, the case where, in the first oil chamber and the second oil chamber, two upper oil passages are arranged above the curved surface portion of the first oil chamber while one upper oil passage is arranged above the inclined surface portion has been indicated, the present invention is not restricted to this example. For example, it is permissible to arrange a plurality of the upper oil passages above the curved surface portion of the second oil chamber while one upper oil passage is arranged above the inclined surface portion. With this structure, reduction of the flow rate of oil at the oil junction can be prevented both in the first oil chamber and the second oil chamber.

Although in the above-described embodiment, the case where the shape of the curved surface portion is based on cycloid curve has been indicated, the present invention is not restricted to this example. For example, the shape of the curved surface portion is not restricted to cycloid curve if any selected shape allows oil dropping from the upper oil passage arranged on the top portion of the wall of the first oil chamber (second oil chamber) to attain the highest flow rate.

Although in the above-described embodiment, the case where the shape of the bottom face of the first oil chamber (second oil chamber) is composed of one curved surface portion and one inclined surface portion has been indicated, the present invention is not restricted to this example. For example, the shape of the bottom face of the first oil chamber (second oil chamber) may be composed of one curved surface portion and two inclined surface portions or may be composed of one curved surface portion and three or more inclined surface portions.

Although, in the above-described embodiment, the case where the inclination angle of the inclined surface portion of the present invention is substantially equal to an inclination angle of the tangent line at the curved surface portion has been indicated, the present invention is not restricted to this example. According to the present invention, the inclination angle of the inclined surface portion may be larger than the inclination angle of the tangent line at the curved surface portion.

Although, in the above-described embodiment, the case where the first oil chamber and the second oil chamber have a shape symmetrical to each other with respect to the partition wall portion has been indicated, the present invention is not restricted to this example. According to the present invention, the first oil chamber and the second oil chamber do not have to have any shape symmetrical to each other with respect to the partition wall portion.

Although, in the above-described embodiment, the partition wall portion is formed between the first oil chamber and the second oil chamber has been indicated, the present invention is not restricted to this example. For example, no partition wall portion has to be formed between the first oil chamber and the second oil chamber.

The present invention can be applied to any internal combustion engine, particularly to an internal combustion engine having a cylinder block containing an oil return space in which a plurality of oil return passages in the cylinder head join together.

The invention claimed is:

1. An internal combustion engine comprising:

a cylinder head having a plurality of oil return passages provided along a column direction of a plurality of cylinder bores; and a cylinder block which is arranged below the cylinder head, and which has (i) the plurality of the cylinder bores, (ii) an oil return space in communication with the oil return passages in the cylinder head, and (iii) an oil discharge passage extending in an axial direction of the cylinder bores, and in communication with the oil return space so as to discharge oil in the oil return space to an oil pan, wherein the oil return space includes a first inclined portion provided on an upstream side in an oil flow direction and to which oil is dropped from a first oil return passage of the plurality of the oil return passages, and a second inclined portion provided on a downstream side and to which oil is dropped from a second oil return passage of the plurality of the oil return passages, the oil return space, including the first inclined portion and the second inclined portion, is located at a lateral side of the cylinder bores, the first inclined portion on the upstream side is curved so as to be convex downward, the second inclined portion on the downstream side is sloped so as to be inclined downward with respect to a horizontal direction, and a curved portion of the first inclined portion on the upstream side is connected to the second inclined portion on the downstream side before a tangent line of the first inclined portion turns to the horizontal direction.

2. The internal combustion engine according to claim 1, wherein a plurality of the first oil return passages is arranged above the first inclined portion of the oil return space so that oil drops from the plurality of the first oil return passages to the first inclined portion.

3. The internal combustion engine according to claim 1, wherein the second inclined portion is formed so as to obliquely intersect with an extension line extending along an axial line of the second oil return passage.

4. The internal combustion engine according to claim 1, wherein an inclination angle of the tangent line of the first inclined portion at a connecting portion between the first inclined portion and the second inclined portion in the oil return space is substantially equal to an inclination angle of the second inclined portion.

5. The internal combustion engine according to claim 1, wherein the tangent line of the first inclined portion at a connecting portion between the first inclined portion and the second inclined portion of the oil return space is inclined with respect to the horizontal direction so as to be directed to a position where the oil return space and the oil discharge passage are connected.

6. The internal combustion engine according to claim 1, wherein the oil return space is adjacent to a water jacket in the cylinder block.

7. The internal combustion engine according to claim 6, wherein the oil return space in the cylinder block is formed in a flat shape extending along the water jacket in the cylinder block, and the first inclined portion and the second inclined portion of the oil return space are formed to extend from a wall surface of the oil return space toward the oil discharge passage along the flat shape of the oil return space.

8. The internal combustion engine according to claim 1, wherein the curve of the first inclined portion of the oil return space is a cycloid curve.

* * * * *